US007658180B2

(12) United States Patent
Geiβel

(10) Patent No.: US 7,658,180 B2
(45) Date of Patent: Feb. 9, 2010

(54) FUEL PUMP AND FUEL FEED SYSTEM FOR AN INTERNAL COMBUSTION ENGINE OF A MOTOR VEHICLE HAVING A FUEL PUMP

(75) Inventor: Eberhard Geiβel, Künzell (DE)

(73) Assignee: Siemens Aktiengesellschaft, Munich (DE)

( * ) Notice: Subject to any disclaimer, the term of this patent is extended or adjusted under 35 U.S.C. 154(b) by 249 days.

(21) Appl. No.: 10/567,654

(22) PCT Filed: Sep. 28, 2005

(86) PCT No.: PCT/EP2005/054884

§ 371 (c)(1),
(2), (4) Date: Feb. 8, 2006

(87) PCT Pub. No.: WO2006/045686

PCT Pub. Date: May 4, 2006

(65) Prior Publication Data

US 2008/0080964 A1 Apr. 3, 2008

(30) Foreign Application Priority Data

Oct. 28, 2004 (DE) ..... 10 2004 052 439

(51) Int. Cl.
*F02M 37/04* (2006.01)

(52) U.S. Cl. ..... 123/497; 123/509; 415/55.1; 417/423.1; 417/423.3

(58) Field of Classification Search ..... 123/509, 123/457, 497; 415/55.5, 55.1, 55.2, 55.3, 415/169.1; 417/423.1, 423.14, 423.3
See application file for complete search history.

(56) References Cited

U.S. PATENT DOCUMENTS

| | | | | |
|---|---|---|---|---|
| 6,152,686 | A | 11/2000 | Neidhard et al. | |
| 6,152,688 | A * | 11/2000 | Staab et al. | 415/55.5 |
| 6,358,412 | B1 | 3/2002 | Strohl et al. | |
| 6,474,310 | B2 | 11/2002 | Joos et al. | |
| 6,478,014 | B1 | 11/2002 | Kohlhaas | |
| 2001/0018908 | A1 | 9/2001 | Joos et al. | |
| 2004/0139946 | A1 * | 7/2004 | Hamada et al. | 123/458 |
| 2004/0211396 | A1 | 10/2004 | Burhenne et al. | |

FOREIGN PATENT DOCUMENTS

| | | | |
|---|---|---|---|
| DE | 197 48 448 | C2 | 12/1999 |
| DE | 199 46 024 | A1 | 7/2000 |
| DE | 100 55 344 | A1 | 5/2001 |
| DE | 100 06 622 | A1 | 8/2001 |
| DE | 197 25 249 | C2 | 5/2002 |

(Continued)

*Primary Examiner*—Stephen K Cronin
*Assistant Examiner*—J. Page Hufty
(74) *Attorney, Agent, or Firm*—Cohen Pontani Lieberman & Pavane LLP

(57) ABSTRACT

In a fuel pump in the form of a side-channel pump for a motor vehicle two partially annular ducts (21, 22) concentrically enclosing one another are connected to one another via a connecting duct (29). Connections (33, 34) of the connecting duct (29) to the partially annular ducts (21, 22) are laid so that at a rated speed of the fuel pump the same pressure prevails in each of them. If the speed falls below the rated speed, fuel passes from the radially outer, partially annular duct (22) into the radially inner, partially annular duct (21). A sufficient delivery capacity through the radially inner, partially annular duct (21) is thereby ensured.

18 Claims, 2 Drawing Sheets

FOREIGN PATENT DOCUMENTS

| | | |
|---|---|---|
| DE | 101 38 838 A1 | 3/2003 |
| DE | 102 46 694 A1 | 4/2004 |
| EP | 0 735 271 B1 | 6/2002 |
| JP | 11510875 | 9/1999 |

* cited by examiner

FUEL PUMP AND FUEL FEED SYSTEM FOR AN INTERNAL COMBUSTION ENGINE OF A MOTOR VEHICLE HAVING A FUEL PUMP

BACKGROUND OF THE INVENTION

The invention relates to a fuel pump having a driven impeller facing a casing part, with rings of guide vanes arranged in the impeller concentrically enclosing one another and defining blade chambers, with partially annular fuel feed ducts facing the rings of guide vanes in the casing part, and with outlet ducts connected to the partially annular ducts, the rings of the blade chambers and the partially annular ducts forming a radially inner delivery chamber and a radially outer delivery chamber. The invention further relates to a fuel feed system for an internal combustion engine of a motor vehicle having such a fuel pump for drawing fuel from a fuel tank and delivering the fuel to the internal combustion engine.

Such fuel pumps are commonly used in fuel feed systems of modern motor vehicles and are known in practice. Here the delivery chambers of the fuel pump serve for filling a swirl pot and for supplying the internal combustion engine of the motor vehicle with fuel. The impeller is generally fixed on a shaft of an electric motor and in normal operation is driven at a rated speed. Particularly when starting the internal combustion engine at low temperatures, however, the rated speed frequently is not reliably achieved, since the electric motor is driven at a low voltage and therefore has only a low power output. This leads, especially in the radially inner delivery chamber, to a greatly reduced delivery capacity of the fuel pump. In the worst case this means that the swirl pot is no longer filled and the delivery of fuel to the internal combustion engine is interrupted.

A further disadvantage of the known fuel feed system is that the impeller in normal operation has to be constantly driven at the rated speed regardless of the fuel demand of the internal combustion engine, in order that the delivery capacity of the radially inner delivery chamber does not fall. This means that the fuel pump has an unnecessarily high energy demand in order to drive the impeller.

BRIEF DESCRIPTION OF THE INVENTION

The object of the invention is to design a fuel pump of the aforementioned type so that it ensures a sufficiently high delivery capacity of the inner delivery chamber even at a low impeller speed below the rated speed. It is furthermore intended to create a fuel feed system having such a fuel pump which ensures a reliable fuel feed at different impeller speeds.

According to the invention the first aforementioned object is achieved in that the radially outer delivery chamber is connected to the radially inner delivery chamber via a connecting duct.

This design enables fuel to flow from the radially outer delivery chamber over to the radially inner delivery chamber when the pressure falls inside the radially inner delivery chamber. Since at low impeller speed the delivery capacity in the radially outer delivery chamber falls considerably less than in the radially inner delivery chamber, this ensures a reliable delivery of fuel in both delivery chambers. The fuel pump according to the invention can therefore also be operated at a speed below the rated speed in the event of a correspondingly low fuel demand of the internal combustion engine without the risk of interrupting the delivery of fuel.

The fuel pump according to the invention is of particularly simple design if the connecting duct is arranged in the casing part and connects the partially annular ducts.

The fuel pump according to the invention is particularly inexpensive to produce if the connecting duct takes the form of a groove arranged in the casing part. Since the casing part of the fuel pump is generally produced by a sintering process or injection molding process anyway, the connecting duct can be produced by a very simple structural modification of the mold shape for the casing part.

In the event of a pressure gradient between the radially outer delivery chamber and the radially inner delivery chamber a fuel supply to the radially inner delivery chamber can be reliably ensured if the connecting duct points away from the radially outer delivery chamber towards the radially inner delivery chamber viewed in the direction of rotation of the impeller. Since the pressure in the radially outer delivery chamber is generally greater than in the radially inner delivery chamber and moreover increases over the length thereof, a suitable choice of the connection of the connecting duct to the radially outer delivery chamber is a simple way of ensuring what minimum pressure is set in the radially inner delivery chamber.

According to another advantageous development of the invention, the connecting duct can easily be prevented from exerting any influence on the flows in the delivery chambers at rated speed if the connections of the connecting duct to the radially inner and the radially outer delivery chambers are laid so that at a rated speed of the impeller the same pressure prevails on both connections. Since at low impeller speed the pressure in the radially inner delivery chamber falls particularly sharply, this design serves by means of the connecting duct to raise the pressure in the radially inner delivery chamber solely when operating below the rated speed.

According to another advantageous development of the invention the connection of the connecting duct to the outer delivery chamber is particularly inexpensive if an initial section of the connecting duct connected to the radially outer, partially annular duct is inclined by a designated angle $\alpha$ to the straight line taken through the axis of rotation of the impeller.

According to another advantageous development of the invention the connection of the connecting duct to the inner delivery chamber is particularly inexpensive if a terminal section of the connecting duct opening into the radially inner, partially annular duct is inclined by a designated angle $\beta$ to the straight line taken through the axis of rotation of the impeller.

According to another advantageous development of the invention, swirling in the delivery chambers as the fuel flows over can be particularly minimized if the angle $\alpha$ and/or the angle $\beta$ is/are approximately 45°.

According to another advantageous development of the invention, the length of the connecting duct can be freely selected, making the minimum pressure in the inner delivery chamber easy to adjust, if the connecting duct has a middle section arranged concentrically between the partially annular ducts.

According to another advantageous development of the invention, any influence exerted on the flow in the connecting duct by friction on the impeller can be particularly minimized if the impeller has a smooth surface in its area facing the connecting duct.

According to another advantageous development of the invention, it is of assistance in further reducing the influence exerted on the flow by friction on the impeller if the connecting duct in the form of a groove is deeper than it is wide. This design is particularly effective in minimizing the contact surface of the impeller with the medium present in the connecting duct.

According to the invention the second aforementioned object, that is to say the creation of a fuel feed system having such a fuel pump and in which a reliable delivery of fuel is ensured at different speeds of the impeller, is achieved in that the radially outer delivery chamber is connected to the internal combustion engine and the radially inner delivery chamber is connected to a jet pump arranged inside the fuel tank.

This arrangement allows the fuel pump to be designed exclusively for the fuel demand of the internal combustion engine, the connecting duct of the fuel pump ensuring that the radially inner delivery chamber receives sufficient fuel. Compared to a fuel feed system in which the jet pump is supplied with fuel via a branch from the line led to the internal combustion engine, the fuel feed system according to the invention, in which the delivery chambers of the fuel pump are connected by way of a connecting duct, is of particularly cost-effective design. The invention means that the fuel feed system according to the invention has two stages connected by the connecting duct, one of which delivers fuel exclusively to the internal combustion engine and the other only feeds fuel inside the fuel tank.

A control device for regulating the power output of an electric motor driving the impeller as a function of the fuel demand of the internal combustion engine means that the fuel feed system according to the invention has an especially low energy demand.

BRIEF DESCRIPTION OF THE DRAWINGS

The invention permits numerous embodiments. In order to further illustrate its basic principle one of these embodiments is represented in the drawing and is described below. In the drawing.

DETAILED DESCRIPTION OF THE INVENTION

Figure 1:
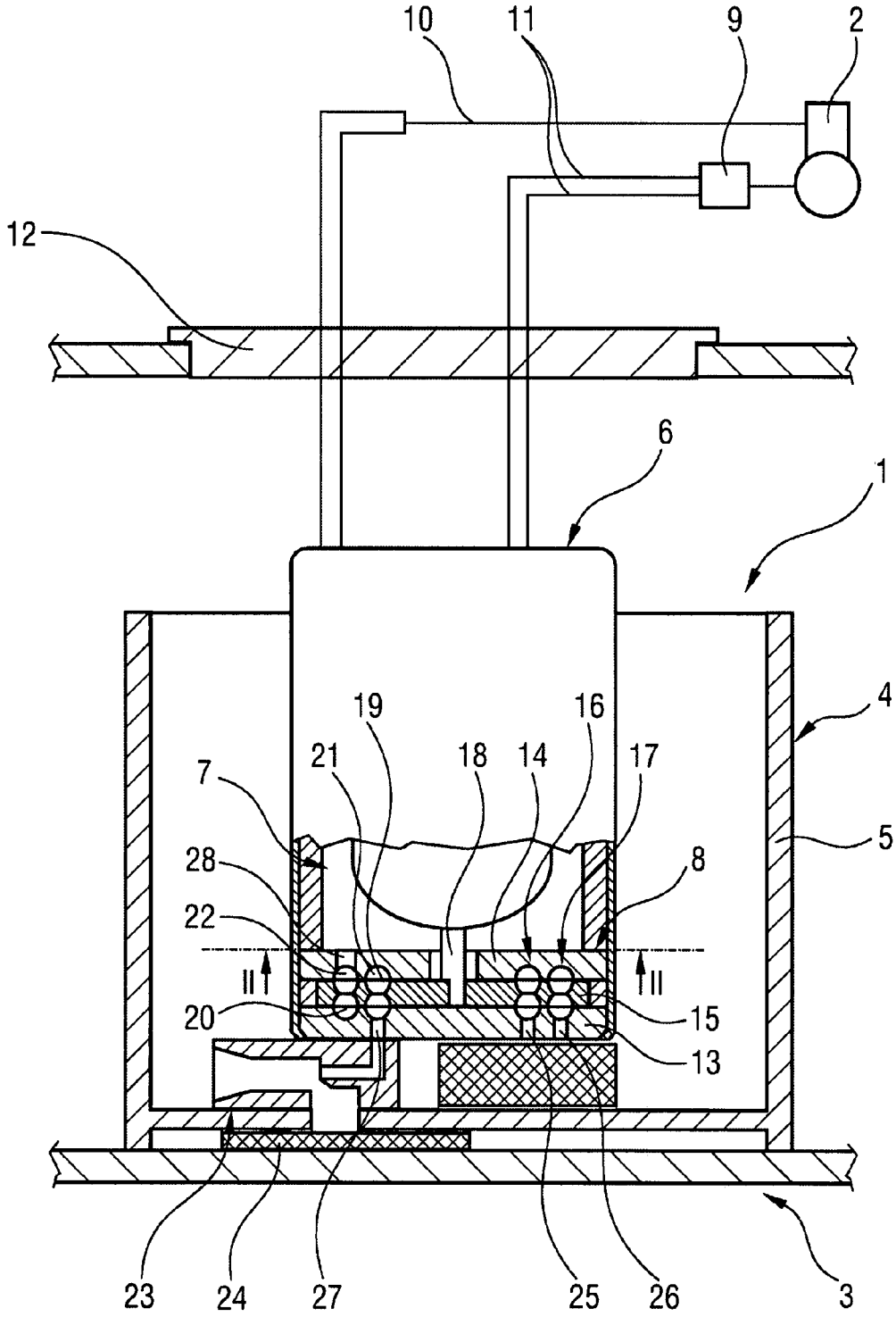
FIG. 1 shows a schematic representation of a fuel feed system having a fuel pump according to the invention.

FIG. 1 shows a schematic representation of a fuel feed system 1 for an internal combustion engine 2 of a motor vehicle having a feed unit 4 arranged in a fuel tank 3. The feed unit 4 has a fuel pump 6, arranged in a swirl pot 5, having a pump stage 8 driven by an electric motor 7. The electric motor 7 is supplied with electrical current via a control device 9. Fuel delivered by the fuel pump 6 passes via a flow line 10 to the internal combustion engine 2. The flow line 10 and electrical leads 11 of the electric motor 7 are led through a flange 12 introduced into the fuel tank 3.

The pump stage 8 takes the form of a side-channel pump and has an impeller 15, rotatably arranged between two casing parts 13, 14, and two delivery chambers 16, 17.

The impeller 15 is rotationally locked on a shaft 18 of the electric motor 7 and has two rings of guide vanes 19, 20 concentrically enclosing one another and defining blade chambers. The blade chambers together with partially annular ducts 21, 22 arranged opposite in the casing parts 13, 14 form the delivery chambers 16, 17. The radially inner delivery chamber 16 delivers fuel from the swirl pot 5 to a jet pump 23, whilst the radially outer delivery chamber 17 delivers fuel from the swirl pot 5 through the electric motor 7 into the flow line 10. The jet pump 23 draws fuel from the fuel tank 3 via a prefilter 24 and delivers this into the swirl pot 5. The delivery chambers 16, 17 each pass through the impeller 15 and therefore have partially annular ducts 21, 22 arranged in each of the casing parts 13, 14. In FIG. 1, for the purpose of illustration, inlets 25, 26 and outlets 27, 28 of the delivery chambers 16, 17 in the casing parts 13, 14 are shown turned into the plane of the drawing. In actual fact the partially annular ducts 21, 22 extend over an angular range of up to 340°.

Figure 2:
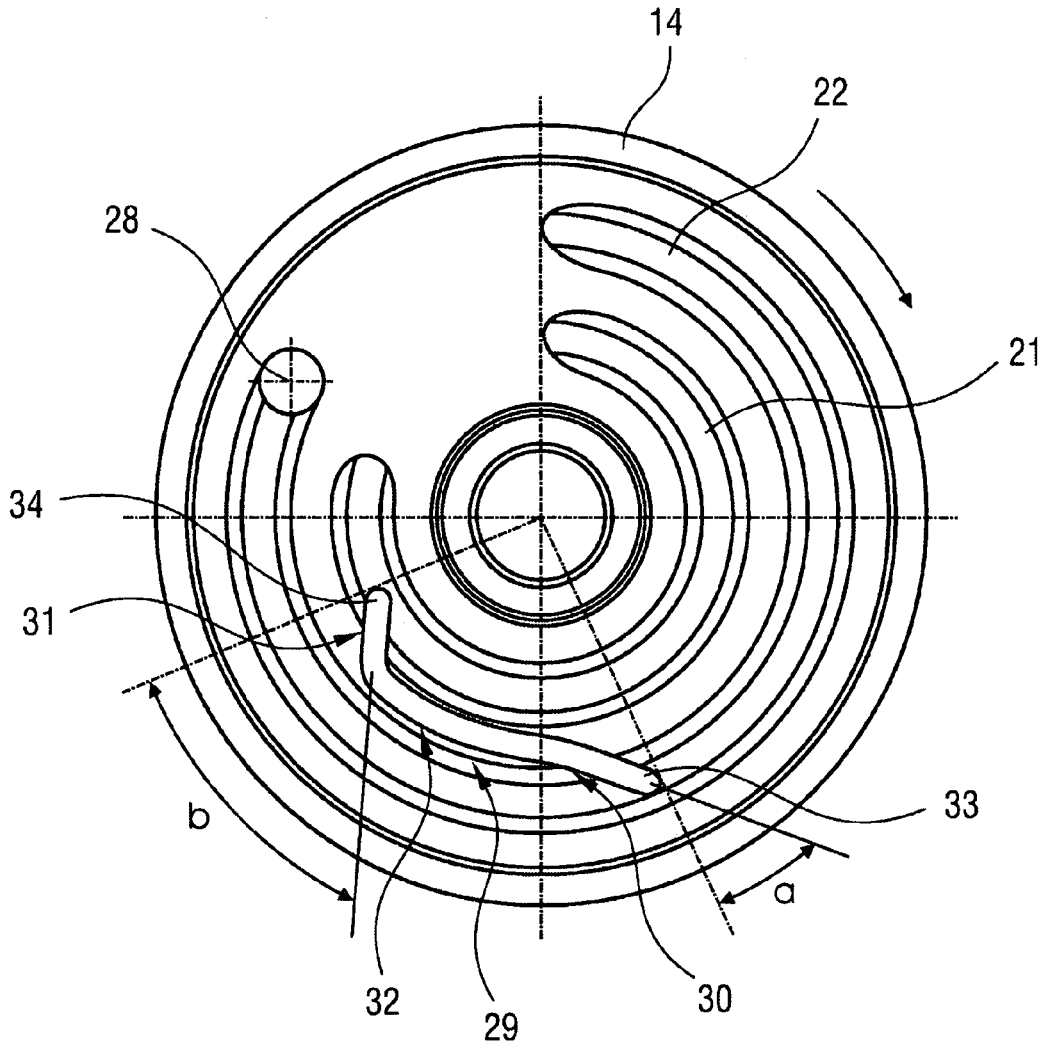
FIG. 2 shows a section through the fuel pump in FIG. 1 along the line II-II.

FIG. 2 shows one of the casing parts 14 of the pump stage 8 of the fuel pump 6 in FIG. 1. This clearly shows the partially annular ducts 21, 22 concentrically enclosing one another, which are arranged facing the rings of the guide vanes 19, 20 of the impeller 15 represented in FIG. 1. The direction of rotation of the impeller 15 is identified by an arrow. FIG. 2 furthermore shows that the partially annular ducts 21, 22 are connected to one another via a connecting duct 29. The connecting duct 29 takes the form of a groove which is arranged in the casing part 14 and is deeper than it is wide. The connecting duct 29 has an initial section 30 connected to the outer partially annular duct 22, and a terminal section 31 opening into the inner partially annular duct 21. The initial section 30 and the terminal section 31 are connected to one another by a middle section 32 arranged parallel to the partially annular ducts 21, 22. The initial section 30 is inclined by the angle $\alpha$ and the terminal section 31 is inclined by the angle $\beta$ to the straight line taken through the axis of rotation of the impeller 15. The angles $\alpha$ and $\beta$ are in each case 45°, for example.

The connecting duct 29 is connected to the partially annular ducts 21, 22 in such a way that at a rated speed of the impeller 15 the same pressure prevails at connections 33, 34 of the connecting duct 29 to the partially annular ducts 21, 22. A pressure equilibrium, which prevents any flow of fuel, thereby prevails in the connecting duct 29. If the speed of the impeller 15 falls below the rated speed, however, the feed pressures in the delivery chambers 16, 17 and hence in the partially annular ducts 21, 22 will also fall. In the radially inner, partially annular duct 21, however, the fall in pressure is much more pronounced than in the radially outer, partially annular duct 22. Such a fall in pressure would mean, however, that the jet pump 23 would no longer be reliably supplied with fuel as propellant. The connecting duct 29 remedies this by diverting fuel from the radially outer delivery chamber 17 in the event of a fall in pressure in the radially inner delivery chamber 16, thereby maintaining the intended pressure in the radially inner delivery chamber 16. The fuel feed system 1 thereby allows the power output of the electric motor 7 to be controlled by the control device 9 according to the fuel consumption of the internal combustion engine 2.

The invention claimed is:

1. A fuel pump comprising:

a driven impeller facing a casing part, with rings of guide vanes arranged in the impeller concentrically enclosing one another and defining blade chambers;

partially annular fuel feed ducts facing the rings of guide vanes in the casing part;

outlet ducts connected to the partially annular ducts, the rings of the blade chambers and the partially annular ducts forming a radial inner delivery chamber and a radial outer delivery chamber;

and a connecting duct connecting the radial outer delivery chamber to the radially radial inner delivery chamber configured so the fuel flows from the radial outer delivery chamber to the radial inner delivery chamber, connections of the connecting duct connect to the radial inner and the radial outer delivery chambers, the connections being laid out so that at a rated speed of the impeller a same pressure prevails on both connections.

2. The fuel pump as claimed in claim 1, wherein the connecting duct is arranged in the casing part and connects partially annular ducts.

3. The fuel pump as claimed in claim 1 or 2, wherein the connecting dud comprises of a groove arranged in the casing part.

4. The fuel pump as defined in claim 1, wherein the connecting duet points away from the radial outer delivery chamber towards the radial inner delivery chamber viewed in a direction of rotation of the impeller.

5. The fuel pump as defined in claim 2, wherein an initial section of the connecting duet connected to the radial outer, partially annular duet is inclined by a designated angle $\alpha$ to the straight line taken through the axis of rotation of the impeller.

6. The fuel pump as defined in claim 2, wherein a terminal section of the connecting duct opening into the radial inner, partially annular duct is inclined by a designated angle $\beta$ to the straight line taken through the axis of rotation of the impeller.

7. The fuel pump as defined in claim 5 or 6, wherein at least one of the angle $\alpha$ or the angle $\beta$ is approximately 45°.

8. The fuel pump as defined in claim 2, wherein the connecting duct has a middle section arranged concentrically between the partially annular ducts.

9. The fuel pump as defined in claim 1, wherein the impeller has a smooth surface in its area facing the connecting duct.

10. The fuel pump as defined in claim 1, wherein the connecting duct is in the form of a groove is deeper than it is wide.

11. A fuel feed system for an internal combustion engine of a motor vehicle having a fuel pump with an impeller for drawing fuel from a fuel tank and delivering the fuel to the internal combustion engine, the pump comprising:

a radial outer delivery chamber that is connected to the internal combustion engine;

a radial inner delivery chamber that is connected to a jet pump arranged inside the fuel tank; and a connecting duct connecting the radial outer delivery chamber to the radial inner delivery chamber.

12. The fuel feed system as defined in claim 11, further comprising a control device for regulating a power output of an electric motor driving the impeller.

13. The fuel feed system as defined in claim 12, wherein a control device regulates a power output based in part on fuel demand of the internal combustion engine.

14. A fuel pump comprising:

a driven impeller facing a casing part, with rings of guide vanes arranged in the impeller concentrically enclosing one another and defining blade chambers;

partially annular fuel feed ducts facing the rings of guide vanes in the casing part;

outlet ducts connected to the partially annular ducts, the rings of the blade chambers and the partially annular duets fanning a radial inner delivery chamber and a radial outer delivery chamber; and a connecting duct connecting the radial outer delivery chamber to the radial inner delivery chamber, wherein fuel is delivered from the radial outer delivery chamber to the radial inner delivery chamber when pressure in the radial inner chamber falls.

15. The fuel pump as defined in claim 14, wherein the connecting duct points away from the radial outer delivery chamber towards the radial inner delivery chamber viewed in a direction of rotation of the impeller.

16. The fuel feed system as defined in claim 11, wherein fuel is delivered from the radial outer delivery chamber to the radial inner delivery chamber when pressure in the radial inner chamber falls.

17. The fuel pump as defined in claim 16, wherein the connecting duct points away from the radial outer delivery chamber towards the radial inner delivery chamber viewed in a direction of rotation of the impeller.

18. The fuel pump as defined in claim 16, further comprising:

a driven impeller facing a casing part, with rings of guide vanes arranged in the impeller concentrically enclosing one another and defining blade chambers;

partially annular fuel feed ducts facing the rings of guide vanes in the casing part; and outlet ducts connected to the partially annular ducts, the rings of the blade chambers and the partially annular ducts forming the radial inner delivery chamber and the radial outer delivery chamber.

* * * * *